US008950232B2

(12) United States Patent
Van Essen

(10) Patent No.: US 8,950,232 B2
(45) Date of Patent: Feb. 10, 2015

(54) HYDRAULIC SWAGE PRESS

(75) Inventor: Frederick Hubert Van Essen, Williamstown (AU)

(73) Assignee: Betaswage Pty Ltd, Williamstown, Victoria (AU)

( * ) Notice: Subject to any disclaimer, the term of this patent is extended or adjusted under 35 U.S.C. 154(b) by 723 days.

(21) Appl. No.: 13/019,621

(22) Filed: Feb. 2, 2011

(65) Prior Publication Data

US 2011/0185784 A1 Aug. 4, 2011

(30) Foreign Application Priority Data

Feb. 2, 2010 (AU) ..... 2010900391

(51) Int. Cl.

| | |
|---|---|
| ***B21D 41/04*** | (2006.01) |
| ***B21J 7/16*** | (2006.01) |
| ***B21D 37/00*** | (2006.01) |
| ***B21D 39/04*** | (2006.01) |

(52) U.S. Cl.

CPC ..... *B21D 37/00* (2013.01); *B21D 39/04* (2013.01); *B21D 41/04* (2013.01)

USPC ..... 72/402

(58) Field of Classification Search

CPC ..... B21D 39/04; B21D 41/04; B21J 9/06; B21J 13/02; B21J 13/025; B21J 13/03

USPC ..... 72/402, 453.01, 76, 370.23, 370.26, 72/416, 452.9; 29/237

See application file for complete search history.

(56) References Cited

U.S. PATENT DOCUMENTS

| | | | | |
|---|---|---|---|---|
| 5,323,697 | A * | 6/1994 | Schrock | 100/232 |
| 6,519,998 | B2 * | 2/2003 | Ertl et al. | 72/402 |
| 6,857,305 | B2 * | 2/2005 | Essen | 72/402 |
| 8,230,714 | B2 * | 7/2012 | Intagliata et al. | 72/402 |
| 2011/0023573 | A1 | 2/2011 | Intagliata et al. | |

OTHER PUBLICATIONS

BrakeQuip BQ1005 Operators Manual dated Aug. 11, 2008.
BrakeQuip BQ1005 Brochure.
CustomCrimp CC600 Operators Manual dated Aug. 19, 2009.
CustomCrimp Newsletter date Mar. 4, 2009.

* cited by examiner

*Primary Examiner* — Debra Sullivan
(74) *Attorney, Agent, or Firm* — Alston & Bird LLP

(57) ABSTRACT

A swaging press (30) includes a piston member (16) and a plurality of die shoes (18), the piston member (16) in use driving the die shoes (18) inwardly during a swaging process in response to axial movement of the piston member (16), the piston member (16) defining a plurality of substantially flat die shoe engaging surfaces (31) configured to provide a polygonal shape in transverse cross-section, each die shoe (16) being located at each corner (32) of the polygonal shape whereby a portion of each dies shoe (16) engages a corresponding die shoe engaging surface (31) on either side of the corner (32).

11 Claims, 6 Drawing Sheets

HYDRAULIC SWAGE PRESS

FIELD OF THE INVENTION

The present invention relates to improvements in hydraulic swage presses and in die shoes used in such swage presses.

BACKGROUND OF THE INVENTION

Hydraulic swage presses are machines that with an array of suitable tooling called "dies" are able to reduce by pressing a product from one diameter to a smaller diameter in a cold state. The product pressed may typically be made of a metal such as steel and may be of cylindrical form but this is not necessarily the case. In the fluid power connector sector, the previously described "product" is called a ferrule and is used to connect a hose to a hose end fitting. Ferrule type connectors are of course also used in other industries, however, increasing demands in the fluid power sector, such as increasing pressure and longer endurance levels, mean that ferrules in that industry are required to do more work and, as a result, higher performance of the swage press is continually sought.

One conventional form of hydraulic swage press design can generally be described as the "cone" type. This type of swage press utilises a piston driven by hydraulic pressure with the piston having a forward operational face recessed in a frusto-conical configuration. This operational face is adapted to co-operate with a series of shoes, each carrying an inwardly facing die, with the shoes having an outer part frusto-conical surface co-operable with the operational face of the piston. In use, as the piston moves forward under applied hydraulic pressure, forward movement of the shoes is prevented and as a result the shoes and connected dies must move inwardly to provide a swaging movement. Many variations of this basic cone type design are possible including twin cone arrangements. Further, it is known to provide one or more pins extending in a circumferential direction between each adjacent die, the pin or pins being slidable within bores in the dies. Springs may also be provided in cone type swage presses extending in a circumferential direction acting between adjacent dies. The springs and pins provide location and stabilizing means for the dies and assistance for returning to an open condition but can fail when subjected to unusual forces during a swaging operation. The advantages of this design include ease of manufacture and therefore low cost, compactness, and a mechanical gain where the thrust exerted by the piston onto the dies can be as much as 4:1 due to the cone angle of the piston. Some disadvantages of the cone design include the "depth" of the assembly and the strain in the configuration due to mis-matching curvature of the frusto-conical surface in the piston and the part frusto-conical surfaces on the co-operating die shoes. This mis-matching of curvatures causes contact bearing to actually occur only along a line where the curves actually match which means, under load, that the conical surfaces actually distort and there is a significant impingement to varying degrees depending on load and relative piston position. As the actual measurement of the final swage diameter is made at the piston, accuracy suffers as well. The bearing load at this point is extreme and many machines of this type seize under load without significant amounts of lubrication.

To overcome some of the shortcomings of the cone type design, another form of swage press has been developed which may be described as a "scissor" type. This type of swaging press utilises a piston driven by hydraulic pressure having a forward V-shaped recess with flat bearing surfaces that, under pressure, moves toward a reaction block also having a V-shaped recess with flat bearing surfaces. Die carrying shoes are located between the piston and the reaction block having flat bearing surfaces engaging with either the bearing surfaces of the piston or the reaction block. The shoes (except those located in the corners of the V-shaped recesses) slide along the bearing surfaces as the piston moves toward the reaction block during a swaging operation. The die carrying shoes are maintained spaced from one another by spring members located between the shoes. The advantages of the scissor type design are that its dimension from front to rear is small compared to a similar dimension of the cone type. In addition, the scissor type design has high loading capability due to the full surface bearing contact described above. A significant disadvantage is, however, that it has a high manufacturing cost due mainly to the 1:1 mechanical gain (i.e. 1 mm of piston movement=1 mm change in swaging diameter) whereas the cone type may have as much as 4:1 mechanical gain. As a result, the piston in a scissor type press will be much larger than in the cone type press.

A further variation of the cone type swaging press may involve machining the frusto-conical surface of the piston in an octagonal shape, in the case of an eight die press, with eight essentially flat but inclined bearing surfaces, each co-operating with a flat but inclined bearing surface on the die shoe. The polygonal configuration would vary from an octagonal configuration depending on the number of dies used in the press. This type of swage press requires guide members to be located between the shoes with spring members also acting between the shoes similar to the spring members in the scissor type design. This arrangement has the advantage that it has a full contact bearing surface engagement similar to the scissor type machine but also has a mechanical gain advantage similar to a cone type design. The disadvantages of this design include that it is difficult to manufacture and the configuration, under radial load, results in the shoes tending to slide to the corners of the octagonal cone as this represents the outer most reactive low energy position. This means that the shoe guides mentioned above must be inserted between the shoes to keep them in correct position. Any wear in the guides will create an irregular swaging action.

In general, as the performance requirements of swage press equipment has increased, manufacturers are tending to produce scissor type designs or cone type designs but of larger diameter where the curvature of the cones are less mismatched.

As the requirements of swage machines have increased with higher swaging loads, so has their flexibility. In earlier days, the swaging diameter was controlled by manufacturing different die sets of varying diameter with the piston moving to one fixed position (the end of stroke). In this position maximum bearing area is achieved with matching cone curvature. Many of these machines cost more in die tooling than in the actual cost of the swage press itself. More contemporary machines control the forward motion of the piston and hence are able to achieve a wide variation of finished swage diameters with a minimal amount of die tooling.

When manufacturing couplings for large diameter industrial hoses, it is more economical to use hollow annular stock that has been rolled and welded to produce a tubular structure. This, however, results in a product that has an axial weld bead where the wall section of the bead region is thicker and the structure/ductility of the metal varies significantly from the remainder of the material of the tubular structure. This can provide significant difficulties with swaging such a manufactured ring in conventional cone and other types of swaging presses and commonly requires positioning of the weld bead in a specific location for the swaging operation to be possible.

SUMMARY OF THE INVENTION

The objective of the present invention is to provide an improved swaging press that will enable swaging of non-homogeneous ferrules, collars and ring type products without damage to the swaging press. Specifically but not exclusively an objective is to enable swaging of ferrules, collars and rings with a weld bead along at least a portion of its circumference without causing damage to the swaging press. Preferably the present invention aims to provide uniform loading between the die shoes and the piston of the swage press. A further objective is to provide swaging presses with extremely high radial load capability.

Accordingly, the present invention provides a swaging press including a piston member and a plurality of die shoes, said piston member being adapted in use to drive said die shoes inwardly during a swaging process in response to axial movement of the piston member, said piston member including a recess defining a plurality of substantially flat die shoe engaging surfaces defining in transverse cross-section a polygonal shape, said swaging press having a said die shoe located at each corner of said polygonal shape whereby a portion of said die shoe engages a said die shoe engaging surface on either side of said corner.

Preferably the portions of the die shoes provide at least a line engagement with a respective said die shoe engaging surface on either side of a respective said corner of the polygonal shape. Alternatively, the portions of the die shoes engaging a said die shoe engaging surface are substantially flat and provide substantially full contact engagement with the die shoe engaging surface on said piston member with which the die shoe engaging surface engages in use. Conveniently the polygonal shape is a regular polygonal shape with equal length sides. Preferably, the polygonal shape has six to ten corners. Conveniently the polygonal shape has eight said corners providing an octagonal cross-sectional shape.

In a further preferred aspect, the present invention provides a die shoe for use in a swaging press, typically of the above described type, said die shoe having an axially extending outer engagement surface configured, in use, to engage an inwardly facing contact surface of an axially movable piston in the swaging press, the axially extending outer engagement surface defining a first axially extending corner region and, on either side of said corner portion, an axially extending engagement portion adapted, in use, to engage the contact surface of said movable piston.

Preferably each said engagement portion comprises a substantially flat axially extending engagement region. Each of the substantially flat axially extending regions may extend between opposed axial ends of the die shoe. Alternatively, a pair of said substantially flat axially extending engagement surfaces may be provided on either side of said corner portion, each said pair of flat axially extending engagement surfaces being axially separated by a stepped region.

Preferred embodiments of the present invention will now be described with reference to the accompanying drawings.

DETAILED DESCRIPTION OF THE DRAWINGS

Figure 1:
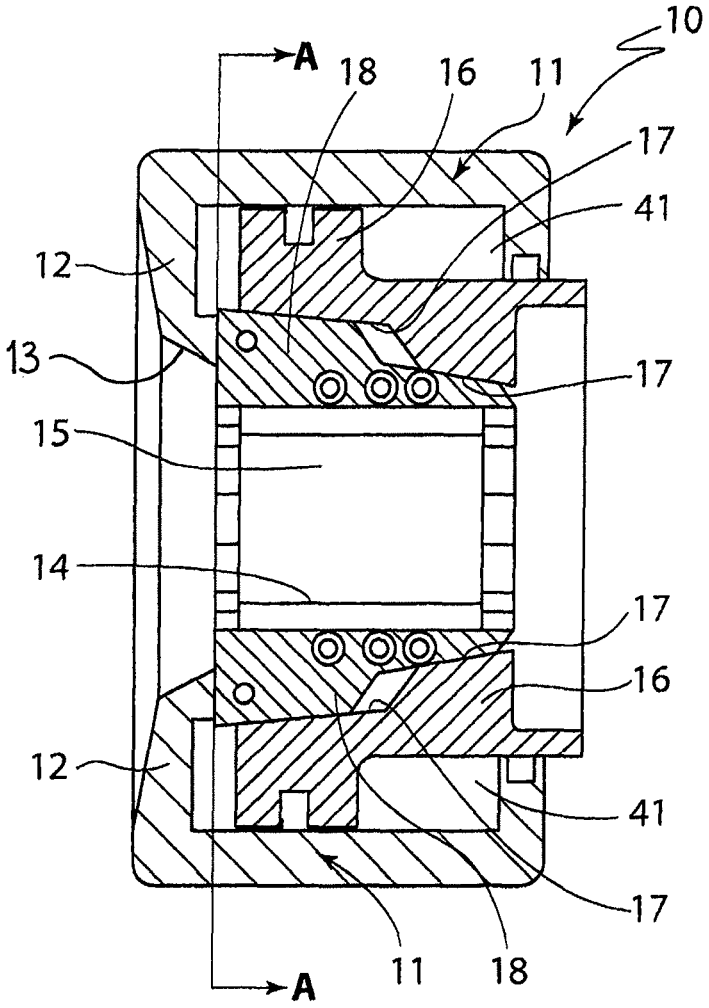
FIG 1 (Prior art)
FIG. 1 is a schematic and illustrative axial section view of a conventional (prior art) cone type swaging press.
Figure 2:
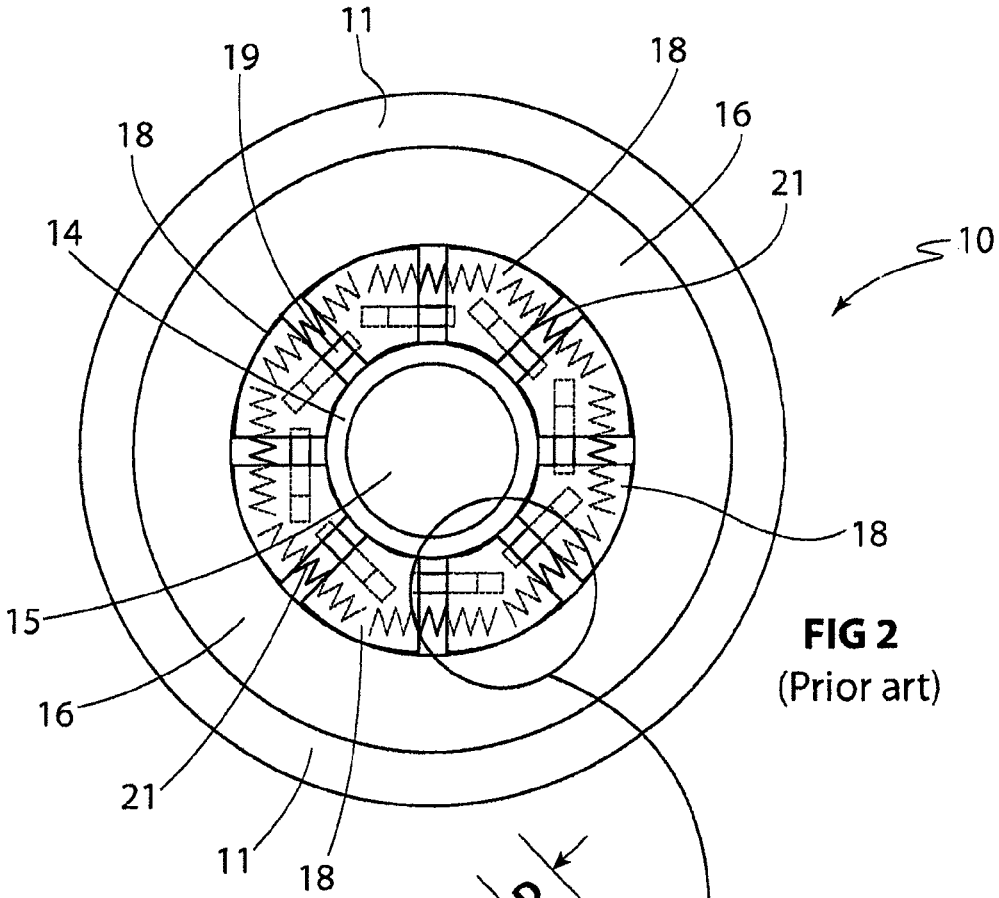
FIG 2 (Prior art)
FIG. 2 is a section view along line A-A of FIG. 1.
Figure 2A:
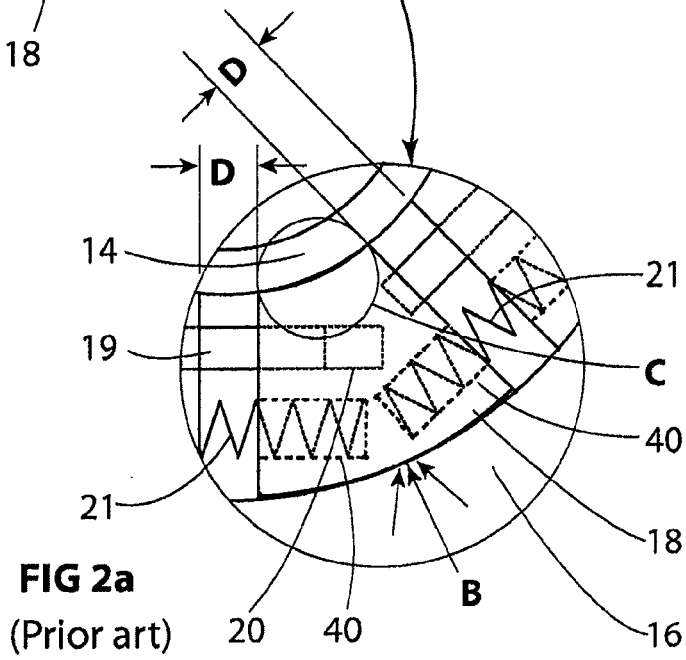
FIG 2a (Prior art)
FIG. 2*a* is a detailed view of a die shoe as shown in FIG. 2.

Referring first to FIGS. 1, 2 and 2*a*, a conventional (prior art) conical swage press 10 is illustrated schematically comprising an outer housing 11 with a front wall 12 and an opening 13 (FIG. 1) to enable a work piece 14 to be placed into a swaging zone 15. A hydraulically operated piston 16 is moved towards the front wall 12 under action of hydraulic forces by pressurized hydraulic fluid introduced into the chamber 41. The piston 16 includes cone surfaces 17 to drive a plurality of circumferentially spaced die shoes 18 inwardly in the swaging zone 15 during a swaging operation. One or more location and stabilizing pins 19 are provided positioned between adjacent die shoes 18 sliding within guide bores 20 provided in the die shoes 18. Compression springs 21 also act between adjacent die shoes 18 located in position by recesses 40 in the die shoes to return the die shoes 18 to their open or expanded position when hydraulic pressure is removed from the chamber 41 and the operating piston 16 moves away from the front wall 12. In the conventional cone type swage press arrangement shown in FIGS. 1, 2 and 2*a*, there is only "line" or point contact between the cone surfaces 17 of the piston 16 and the contact surfaces of the die shoes 18 as shown at B in FIGS. 2*a*, 3 and 4. As shown in FIG. 2*a*, there is minimal radial compression (shown at C) under the die shoe 18 as it contacts the work piece 14. There is, however, significant compression (shown at D) in between the die shoe elements 18 as they converge during a swaging process.

Figure 3:
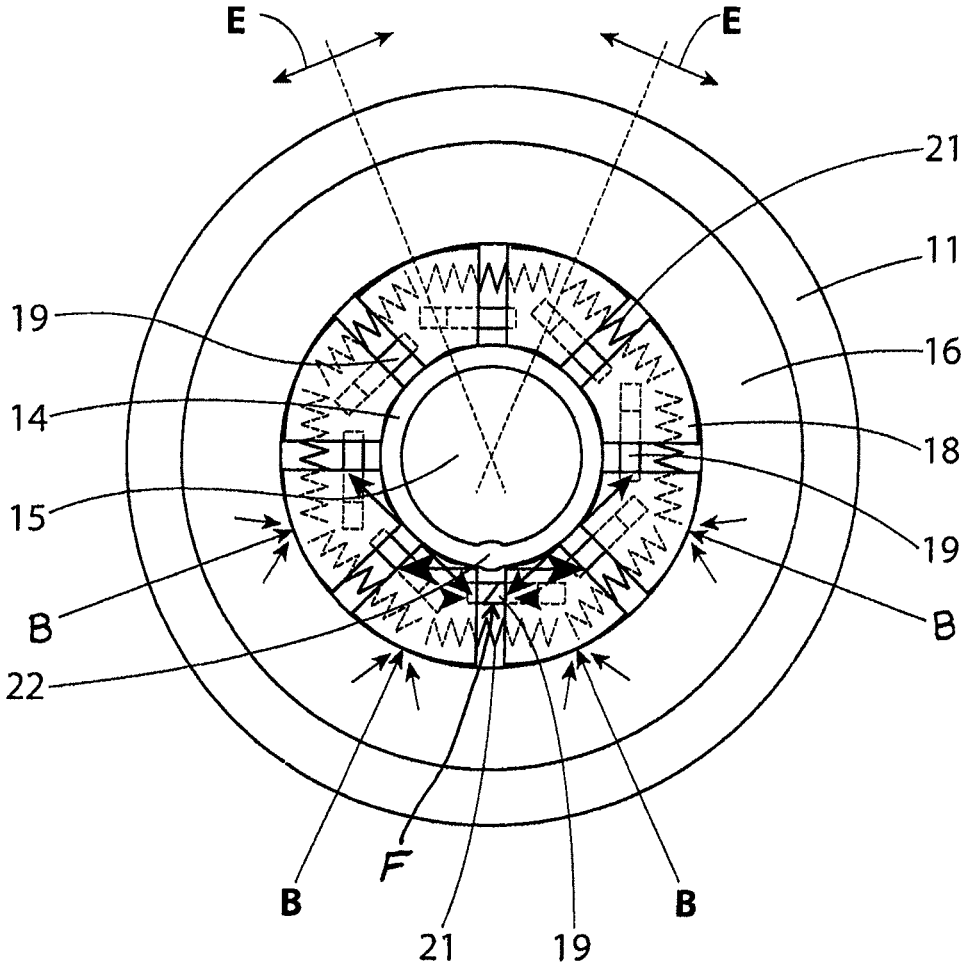
FIG 3 (Prior art)
FIG. 3 is a view similar to FIG. 2 showing a conventional (prior art) cone type swaging press seeking to swage a ring element manufactured with an axial weld bead, the weld bead being positioned between adjacent dies of the swage press.
Figure 4:
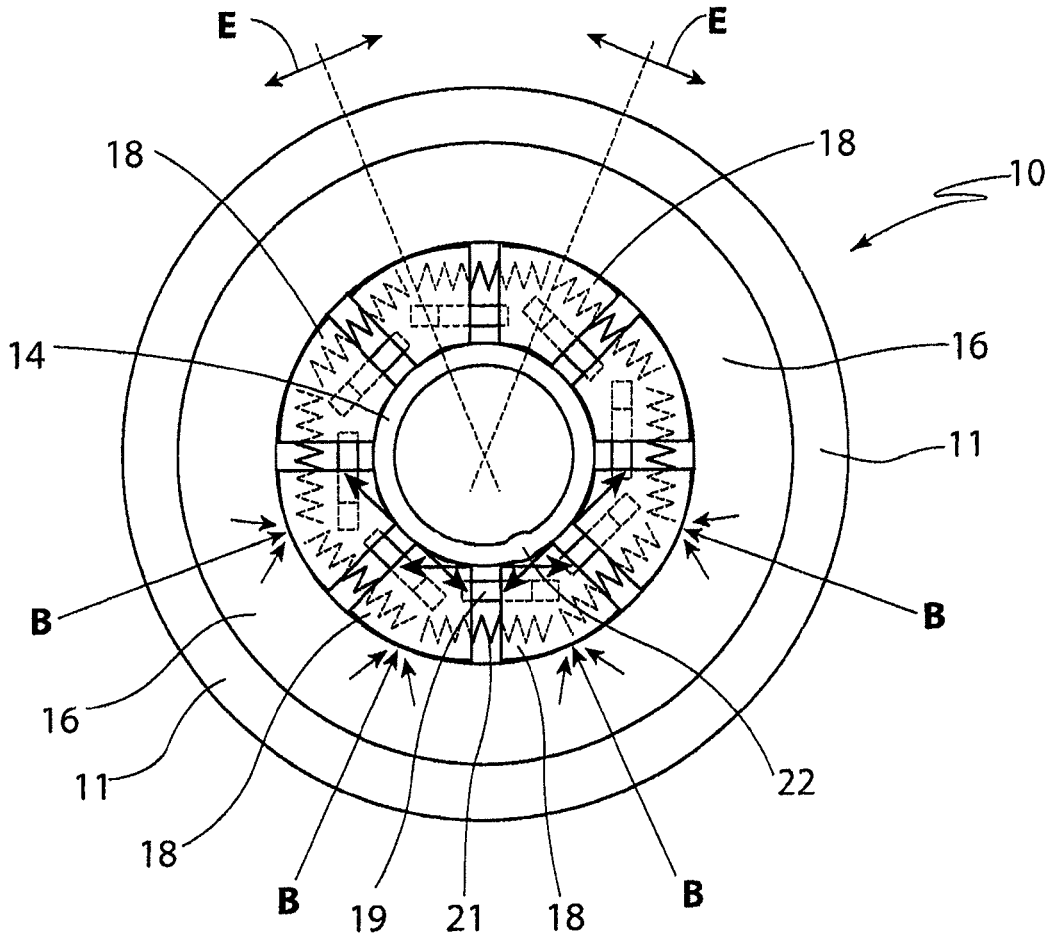
FIG 4 (Prior art)
FIG. 4 is a view similar to FIG. 3 showing a conventional cone type swaging press seeking to swage a ring element manufactured with an axial weld bead, the weld bead being directly engaged by a die of the swage press.

Referring now to FIG. 3, the swaging press of FIGS. 1, 2 and 2*a* is shown carrying out a swaging process on a work piece 14 with a weld bead 22 along its circumference. In this case the weld bead 22 is positioned generally between two adjacent die shoes 18. As the die shoe elements 18 converge during a swaging operation, an unbalanced tangential force is generated resulting a rotational moment within the die shoes 18. As the die shoes 18 contact the piston 16 along a "line", there is no restriction to the position or orientation of the shoes 16 as indicated by arrows E except for the alignment pins 19 between each opposed set of die shoes 18. The pins 19 try to restrain this rotational movement, but ultimately under the high loads involved, the pins 19 tend to break as illustrated schematically at F in FIG. 3 as the forces increase, resulting in a catastrophic failure. FIG. 4 shows the same but where the weld bead 22 is positioned directly under a die shoe element 18. In this case, little or no compression occurs and no tangential forces or rotational moments are created. As a result no damage should result in the swaging press. It is, however, inconvenient and almost impossible for workers to position the weld bead always under a die shoe 18 as represented in FIG. 4.

Figure 5:
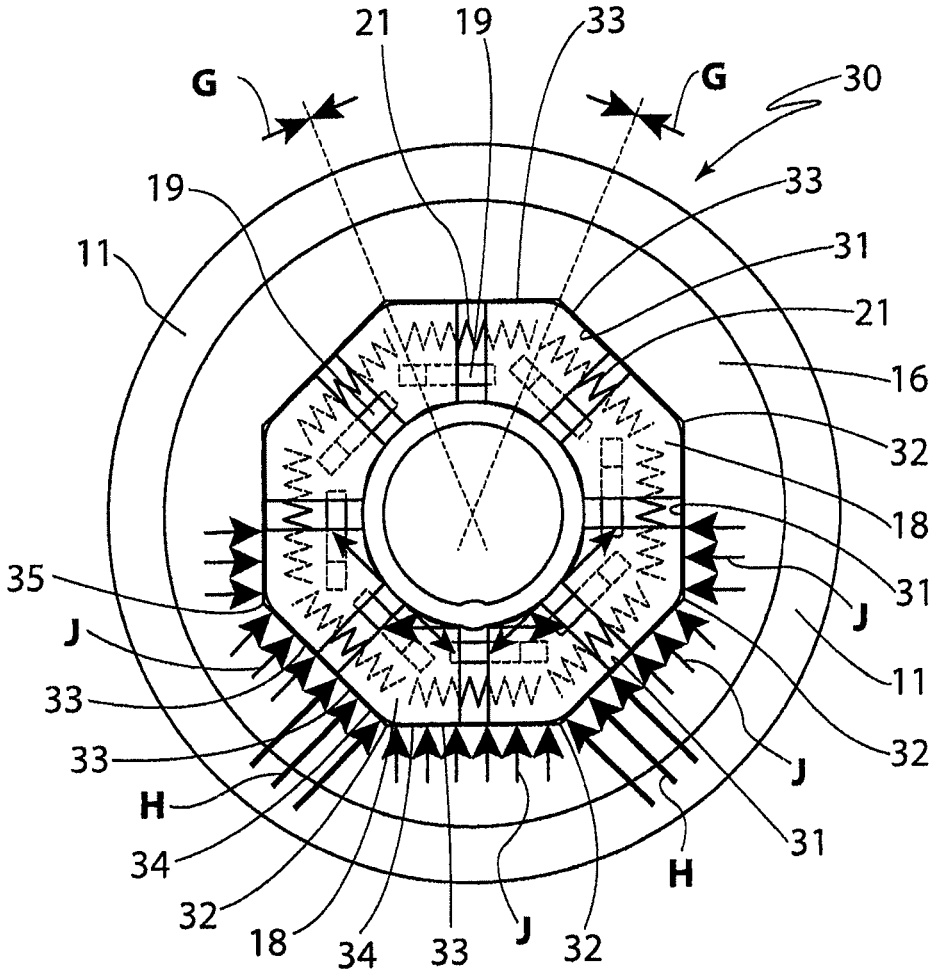
FIG. 5 is a view similar to FIG. 3 showing a swage press according to a preferred embodiment of the present invention where the weld bead is positioned between adjacent dies.
Figure 6:
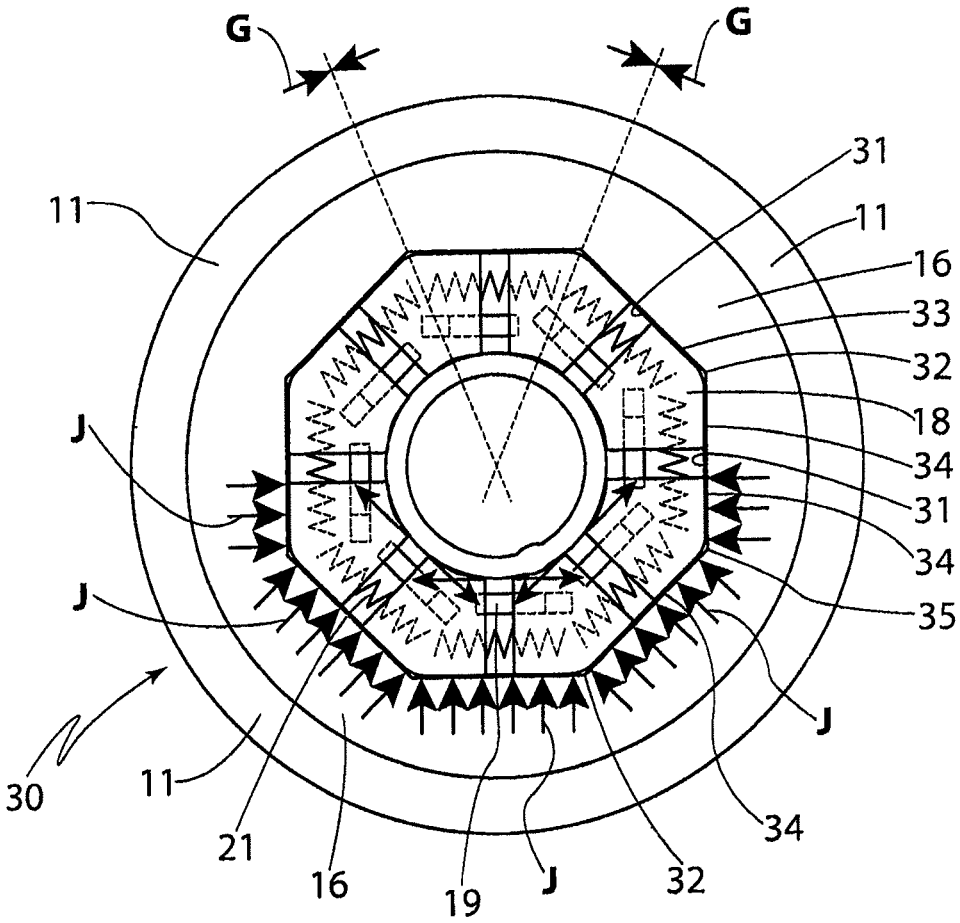
FIG. 6 is a view similar to FIG. 5 showing a swage press according to the preferred embodiment of the present invention where the weld bead is positioned for direct engagement with a die of the swage press.

FIGS. 5 and 6 of the annexed drawings illustrate schematically a swage press 30 in accordance with the present invention. In the illustrated arrangement, the piston member 16 includes internal surfaces 31, the surfaces 31 rather than being conical with a circular configuration as is the surfaces 17 of the earlier described conventional arrangements, are polygonal in cross-section with the surface 31 or surfaces 31 converging axially. In the illustrated embodiment, an octagonal arrangement is shown with eight such surfaces 31 located around the inner periphery of the piston 16. The surfaces 31 may be in a stepped arrangement (FIG. 1) or may be a single converging surface. Each surface 31 is substantially flat and meets at axially extending corners 32 to provide the octagonal configuration illustrated.

As further shown in FIGS. 5 and 6, each of the die shoes 18 has an outer contact surface 33 adapted to engage at least two surfaces 31 of the piston 16 on either side of a corner 32. The contact surface 33 might be curved or might be configured with a flat zone 34 making substantially full surface contact with the surfaces 31, the zones 34 being separated by a curved surface portion 35 positioned adjacent the corner 32.

This arrangement enables an operator to swage a welded bead pipe (or similar) in any orientation (see FIGS. 5 and 6) with no possibility of damage to the press as well as enabling the press to operate at significantly higher radial loads due to the multiple contact or substantially "continuous" contact between shoe and piston. This provides for a swage press that is more "rigid" than a typical cone swage press design which only has a single "line" contact (e.g. FIGS. 1, 2, 2*a*).

FIGS. 5 and 6 demonstrate that the swage press can swage welded bead pipe in any orientation without damage. As shown in FIG. 5, with the weld bead between the shoes, a higher uniform force H on one side of the shoe eliminates any movement set up by the weld bead position. As shown in FIG. 6, with the weld bead positioned under the die element or shoe, a uniform load J equally counters any damaging movement being established that might adversely affect the pins 19. Another feature of the design is that the shoes are positioned in the "lowest energy" position, i.e. the corners 32. This means that no shoe positional bearings, that can wear over time, are required.

While the foregoing illustrates and describes a preferred embodiment of the invention, it will be understood by those skilled in this art that variations and modifications within the scope of the annexed claims are possible. For example, although the drawings shown an octagonal configured press, other polygonal shapes can be employed. Preferably the polygonal shapes utilized might provide six to ten corners. Preferably the polygonal shape might be a regular polygonal shape where the contact surfaces 31 have a substantially equal width at each transverse cross-sectional position.

What is claimed is:

1. A cone-type swaging press comprising:

a single piston member axially movable along an actuation axis during a swaging process, said single piston member having at least one group of a plurality of substantially flat die shoe engaging surfaces connected together at adjacent axially extending edges to form fixed corners with each said substantially flat die shoe engaging surface facing inwardly toward said actuation axis and being angled to converge toward said actuation axis, said substantially flat die shoe engaging surfaces defining in transverse cross-section, a fixed polygonal shape;

drive means for driving said single piston member axially along said actuation axis during a swaging process; and a plurality of die shoes engaged by the substantially flat die shoe engaging surfaces of the single piston member to move said die shoes radially inwardly as said single piston member is moved axially along said actuation axis, a respective said die shoe being located at each said fixed corner of said polygonal shape such that engagement portions of said die shoe at said fixed corner engage said substantially flat die shoe engaging surfaces on either side of said corner.

2. A cone-type swaging press according to claim 1 further including a housing, said single piston member being movably mounted within said housing, and said drive means including a pressurized hydraulic fluid drive device.

3. A cone-type swaging press according to claim 1 wherein the engagement portions of each said die shoe provide at least a line engagement with a respective said substantially flat die shoe engaging surface on either side of said corner of the polygonal shape.

4. A cone-type swaging press according to claim 1 wherein the engagement portions of each said die shoe engaging a said substantially flat die shoe engaging surface provide substantially full surface contact engagement with a said substantially flat die shoe engaging surface on either side of said corner of the polygonal shape.

5. A cone-type swaging press according to claim 1 wherein said polygonal shape is a regular polygonal shape with equal fixed length sides.

6. A cone-type swaging press according to claim 5 wherein said polygonal shape has six to ten equal fixed length sides.

7. A cone-type swaging press according to claim 6 wherein said polygonal shape has eight equal fixed length sides.

8. A cone-type swaging press according to claim 1 wherein each said die shoe has an axially extending outer engagement surface, the axially extending outer engagement surface defining a first axially extending corner region and, on either side of said corner region, an axially extending engagement portion including a flat axially extending zone to engage a said substantially flat die shoe engaging surface on said single piston member.

9. A cone-type swaging press according to claim 8 wherein said substantially flat axially extending zones on the outer engagement surface of each said die shoe extends between opposed axial ends of each said die shoe.

10. A cone-type swaging press according to claim 8 wherein each said substantially flat axially extending zone on the outer engagement surface of each said die shoe converges toward the actuation axis.

11. A cone-type swaging press comprising:

(a) a housing;

(b) a single piston member mounted within said housing being axially movable along an actuation axis during a swaging process, said single piston member comprising:

(i) a first group of a plurality of substantially flat die shoe engaging surfaces connected together at adjacent axially extending edges to form axially extending fixed corners with each said substantially flat die shoe engaging surface facing inwardly toward said actuation axis and being angled to converge toward said actuation axis;

(ii) a second group of a plurality of substantially flat die shoe engaging surfaces connected together at adjacent axially extending edges to form axially extending fixed corners, said second group being axially spaced along said actuation axis relative to said first group, the substantially flat die shoe engaging surfaces of said second group facing inwardly toward said actuation axis and being angled to converge toward said actuation axis;

(iii) the substantially flat die shoe engaging surfaces of both said first and second groups defining in transverse cross-section, a fixed polygonal shape; and (iv) the first and the second groups being axially joined by a stepped ramp zone with each said axially extending fixed corner of the second group being substantially aligned with a said axially extending fixed corner of the first group;

(c) drive means for driving said single piston member axially along said actuation axis; and (d) a plurality of die shoes engaged by the substantially flat die shoe engaging surfaces of the single piston member to move said die shoes radially inwardly as said single piston member is moved axially along said actuation axis by said drive means, a respective said die shoe being located at each said axially extending fixed corner such that engagement portions of said die shoe at said axially extending fixed corner engage said substantially flat die shoe engaging surfaces on either side of said axially extending fixed corner.

* * * * *